US008898838B1

(12) United States Patent
Tu

(10) Patent No.: US 8,898,838 B1
(45) Date of Patent: Dec. 2, 2014

(54) METHOD AND APPARATUS FOR A CONVERTIBLE PATIENT BED

(71) Applicant: Ton Duc Thang University, Ho Chi Minh (VN)

(72) Inventor: Cong Thanh Diep Tu, Ho Chi Minh (VN)

(73) Assignee: Ton Duc Thang University, Ho Chi Minh (VN)

( * ) Notice: Subject to any disclaimer, the term of this patent is extended or adjusted under 35 U.S.C. 154(b) by 0 days.

(21) Appl. No.: 14/229,836

(22) Filed: Mar. 29, 2014

Related U.S. Application Data

(63) Continuation of application No. 14/164,147, filed on Jan. 25, 2014.

(51) Int. Cl.
*A61G 7/02* (2006.01)
*A61G 7/015* (2006.01)
*A61G 7/018* (2006.01)

(52) U.S. Cl.
CPC *A61G 7/015* (2013.01); *A61G 7/02* (2013.01); *A61G 7/018* (2013.01)
USPC ..... 5/604; 5/605; 5/606; 5/695; 5/618

(58) Field of Classification Search
USPC ..... 5/604–606, 695, 618
See application file for complete search history.

(56) References Cited

U.S. PATENT DOCUMENTS

| | | | | |
|---|---|---|---|---|
| 5,077,845 | A * | 1/1992 | Tokunaga et al. | 5/605 |
| 6,101,646 | A * | 8/2000 | Son | 5/604 |
| 6,374,437 | B1 * | 4/2002 | Voelker | 5/600 |
| 6,795,988 | B2 * | 9/2004 | Hueppe | 5/426 |
| 6,934,987 | B2 * | 8/2005 | Newkirk et al. | 5/613 |
| 7,363,663 | B2 * | 4/2008 | Chambers et al. | 5/185 |
| 7,406,729 | B2 * | 8/2008 | Hornbach et al. | 5/613 |
| 7,444,696 | B2 * | 11/2008 | Lin et al. | 5/613 |
| 2006/0101580 | A1 * | 5/2006 | Biggie et al. | 5/710 |
| 2008/0000028 | A1 * | 1/2008 | Lemire et al. | 5/618 |
| 2009/0293197 | A1 * | 12/2009 | Larson et al. | 5/618 |
| 2010/0005592 | A1 * | 1/2010 | Poulos et al. | 5/618 |
| 2012/0068862 | A1 * | 3/2012 | Tillotson | 340/963 |

* cited by examiner

*Primary Examiner* — William Kelleher

(57) ABSTRACT

A convertible patient bed is disclosed that includes: a middle section, a top section, and a bottom section, each section further includes a first lateral subsection and a second lateral subsection; a push-pull motor coupled to push the top section and to pull the bottom section to transform the patient bed into a chair, a sliding motor coupled to slide the said first lateral subsection and said second lateral subsection in and out of each of the middle section, top section, and bottom section respectively at a predetermined angle to change the width of the patient bed; and a motor coupled to an opening and a cover in the middle of the middle section to accommodate to the needs of a patient.

20 Claims, 7 Drawing Sheets

METHOD AND APPARATUS FOR A CONVERTIBLE PATIENT BED

CLAIM OF PRIORITY

This application is a continuation of application Ser. No. 14/164,147, filed Jan. 25, 2014, entitled, "Method and Apparatus for a Convertible Patient Bed". The patent application identified above is incorporated here by reference in its entirety to provide continuity of disclosure.

FIELD OF THE INVENTION

The present invention relates generally to the field of medical devices. More specifically, the present invention relates to a patient transport apparatus.

BACKGROUND ART

Patient beds play a very important role in helping a patient to recover because most of the time the patient will spend their time therein. The comfort the patient bed brings to a patient and the easy access it provides to medical assistants will accelerate the process of recovery for a patient.

Given the above facts, the design and manufacturing of low-cost patient beds adaptable to different scenario are crucial, especially in crowded hospital and narrow alleys. Today, there are different commercialized patient beds such as Rainbow Care, Alphamed Pte, Stryker, etc. These are various types of patient beds that are operated either manually or with motors.

These above mentioned patient beds are usually expensive and cannot adapt to narrow areas. Moreover, with conventional patient beds when transforming into a chair, it is necessary to disassembling some sections of the bed. Reversely, when returning the chair back into patient bed, patient needs to assemble back those disassembled sections.

Furthermore, conventional beds more often are too large causing patients discomforts. Consequently, large patient beds cannot move along crowded hospital corridors.

Therefore what is needed is a low cost patient bed that can conveniently change into a chair and change its width to make patients feel comfortable and achieve fast recovery.

SUMMARY OF THE INVENTION

Accordingly, an objective of the present invention is to provide a portable device that can efficiently ently and conveniently remove and clean a nasal passage. Thus, a convertible patient bed is disclosed that includes: a middle section, a top section, and a bottom section, each section further includes a first lateral subsection and a second lateral subsection; a push-pull motor coupled to push the top section and to pull the bottom section to transform the patient bed into a chair, a sliding motor coupled to slide the said first lateral subsection and said second lateral subsection in and out of each of the middle section, top section, and bottom section respectively at a predetermined angle to change the width of the patient bed; and a motor coupled to an opening and a cover in the middle of the middle section to accommodate to the needs of a patient.

These and other advantages of the present invention will no doubt become obvious to those of ordinary skill in the art after having read the following detailed description of the preferred embodiments, which are illustrated in the various drawing Figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
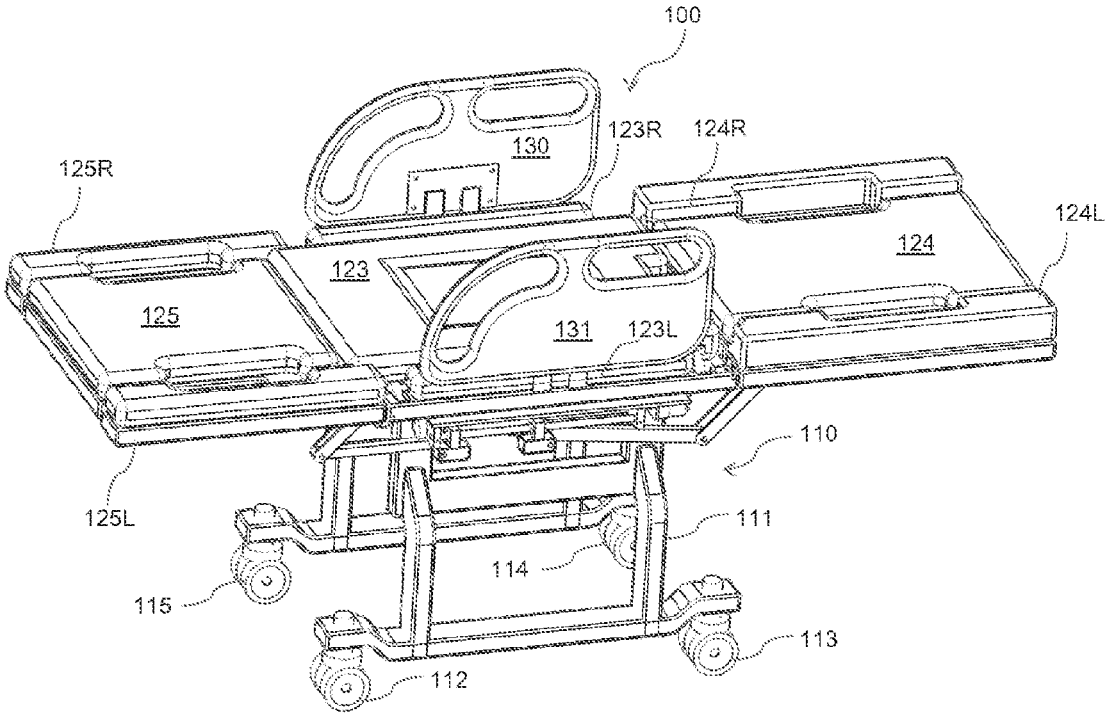
FIG. 1 is a diagram illustrating a perspective view of a convertible patient bed in accordance to an embodiment of the present invention.

One embodiment of the invention is now described with reference to FIG. 1 to FIG. 6. FIG. 1 shows one embodiment of patient bed 100. Patient bed 100 includes a supporting frame 111 having a first caster wheel 112, a second caster wheel 113, a third caster wheel 114, and a fourth caster 115. As a result, patient bed 100 is conveniently to be pushed and pulled at any direction.

Directly atop of supporting frame 111 is a rectangular middle section 123. Rectangular middle section 123 is mechanically connected to supporting frame 111. Rectangular middle section 123 has a top side, a bottom side, a left side, and a right side. Rectangular middle section 123 further includes a first lateral subsection 123R and a second lateral subsection 123L. First lateral subsection 123R is slidably connected to the right side of rectangular middle section 123, and second lateral subsection 123L is slidably connected to the left side of rectangular middle section 123. In one embodiment, rectangular middle section 123 further includes an opening 123O and a removable cover 123C. Opening 123O is configured to allow a patient to excrete when removable cover 123C is opened.

Continuing with the description of FIG. 1, a top section 124 is mechanically connected to supporting frame 111 and to the top side of rectangular middle section 123. Top section 124 has a third lateral side 124R and a fourth lateral side 124L.

Rectangular middle section 123 also includes a right-hand-side wing 130 and a left-hand-side wing 131. Right-hand-side wing 130 and left-hand-side wing 131 has a large surface and openings so as to help a patient to rest their arms and to keep medicines, foods, or beverages. In one embodiment, right-hand-side wing 130 and left-hand-side wing 131 are configured to flip up and down.

Figure 2:
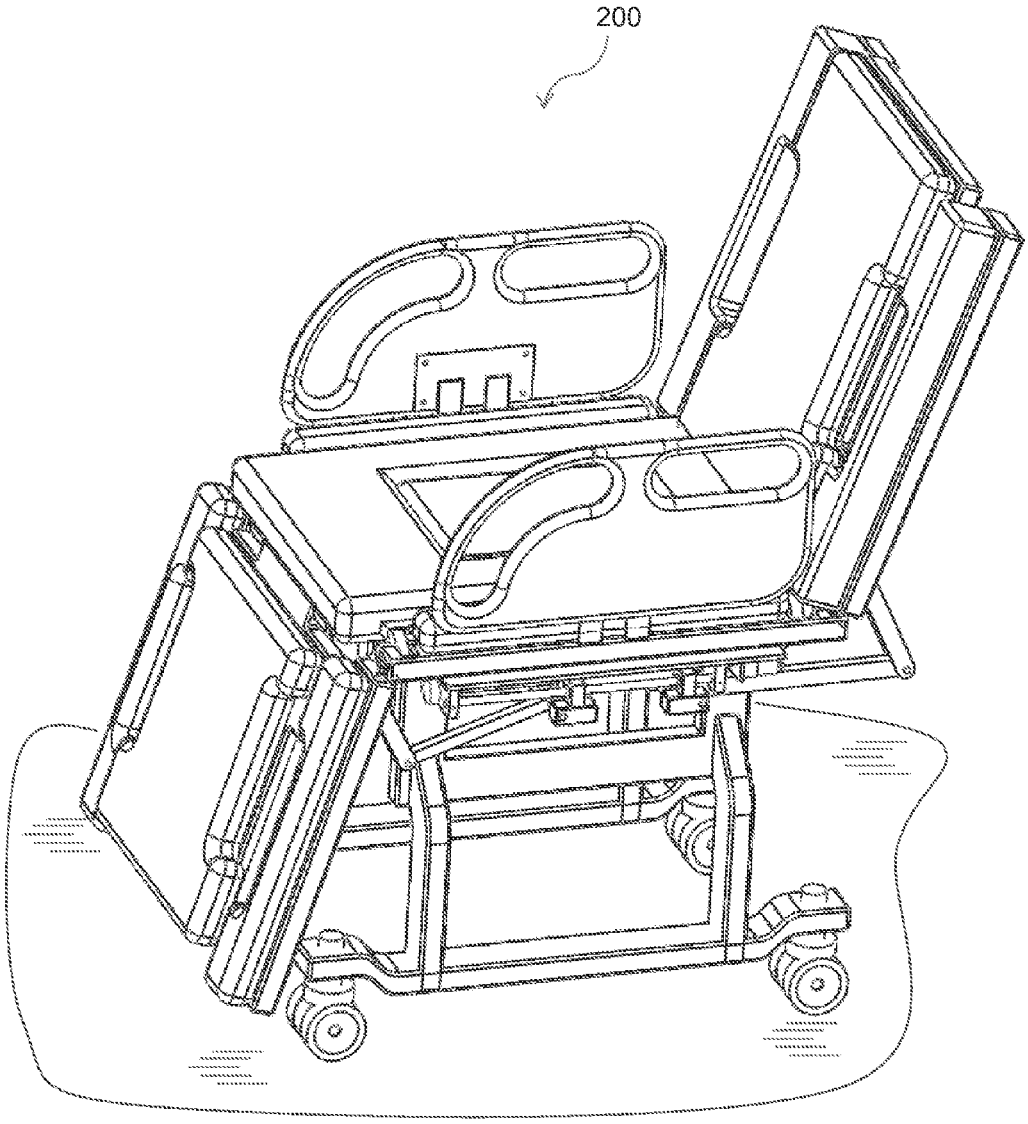
FIG. 2 is a diagram illustrating a perspective view of a convertible bed of FIG. 1 when it is transformed into a chair in accordance with an embodiment of the present invention.

Now referring to FIG. 2, FIG. 2 illustrates patient bed 100 in FIG. 1 which is transformed into a chair 200.

Figure 3:
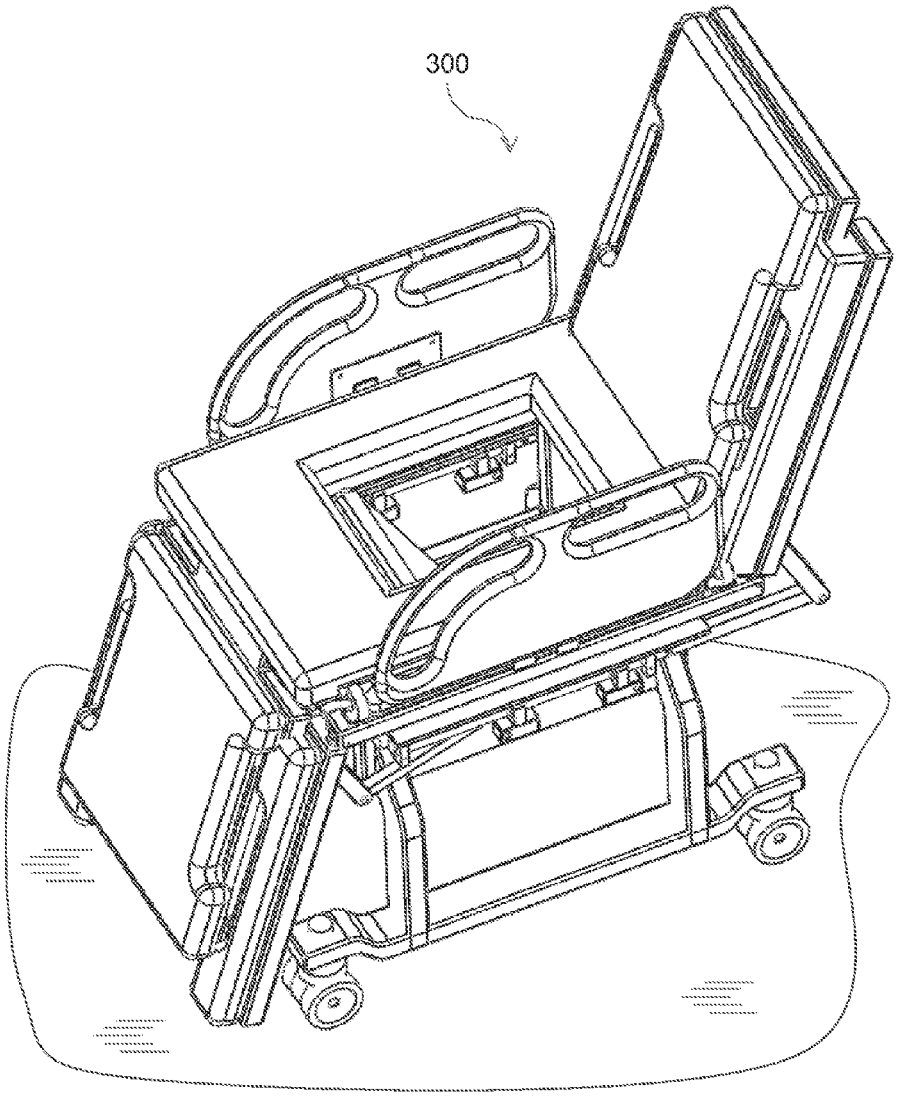
FIG. 3 is a diagram illustrating a perspective view of a convertible patient bed of FIG. 1 when the middle section is opened up to accommodate to a patient's needs.

Next referring to FIG. 3, FIG. 3 illustrates patient chair 200 of FIG. 2 where patient bed 100 of FIG. 1 is turned into a chair and opening 123O is opened to allow a patient to excrete. In another word, cover 123C is lowered so that opening 123 is introduced.

Figure 4:
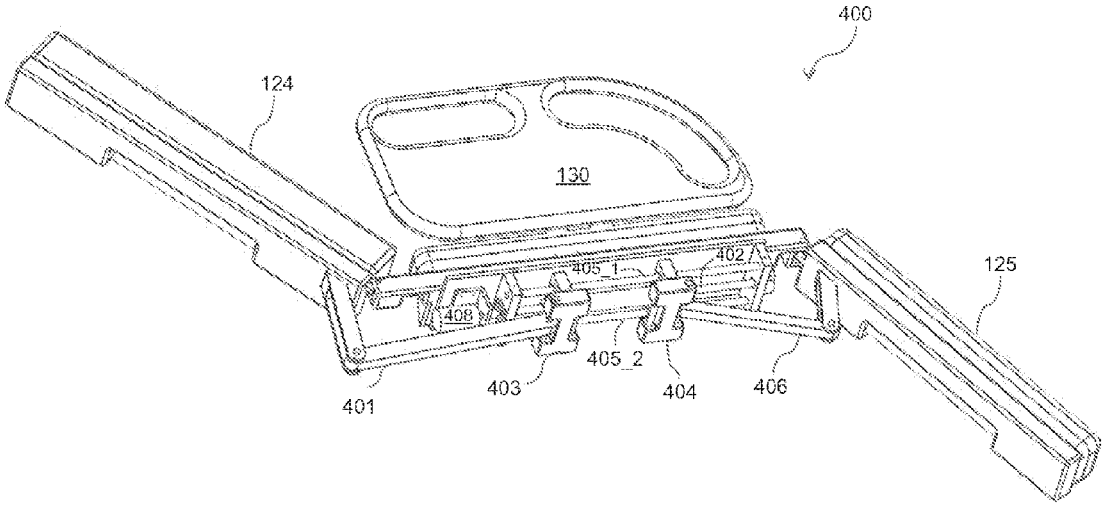
FIG. 4 is a diagram illustrating a cross-sectional view of the sliding motor that enables the patient bed to transform into a chair as shown in FIG. 2.

Referring now to FIG. 4, FIG. 4 illustrates a sliding assembly 400 for transforming patient bed 100 into patient chair 200 as shown in FIG. 2. More particularly, sliding assembly 400 includes a main bar 402 and a peripheral bars 405_1 and 405_2, a first moving block 403, and a second moving block 404. First moving block 403 and second moving block 404 are coupled to both main bar 402 and peripheral bars 405_1, 405_2, and are sliding back and forth along main bar 402 and peripheral bars 405_1 and 405_2 by means of a motor 408. First moving block 403 is connected to main bar 402 and peripheral bars 405_1 and 405_2 and to a rotating arm 401. Similarly, second moving block 404 is connected to main bar 402 and peripheral bars 405_1, 405_2, and connected to a different rotating arm 406.

Still referring to FIG. 4, on the other side of rectangular middle section 123, top section 124 and bottom section 125, there are similar sliding assembly 400 so that sliding assemblies 400 are operative to transform patient bed 100 into patient chair 200 and vice versa.

In operation, when motor 408 is activated, it pushes first moving block 403 and second moving block 404 along main bar 402 and peripheral bars 405_1, 405_2. In effect, first moving blocks 403 and second moving block 404 on left side and on right side of rectangular middle section 123 are sliding together in synchronization back and forth, left to right and vice versa. In order to turn patient bed 100 into patient chair 200, first moving parts 404 pulls rotating arms 406, pulling bottom section 125 downward forming an angle with rectangular middle section 123. At the same time, second moving part 403 pushes rotating arms 401, erecting top section 124 and forming an angle with rectangular middle section 123.

Similarly, in order to turn patient chair 200 into patient bed 100, first moving parts 404 pushing rotating arms 406, pushing bottom section 125 forward bringing bottom section 125 into a co-planar position with rectangular middle section 123. At the same time, second moving parts 403 pull rotating arms 401, bringing top section 124 back to co-planar position with rectangular middle section 123. In one embodiment, motor 408 has a power of 28 watts and a speed of 40 rounds per minutes.

Figure 5:
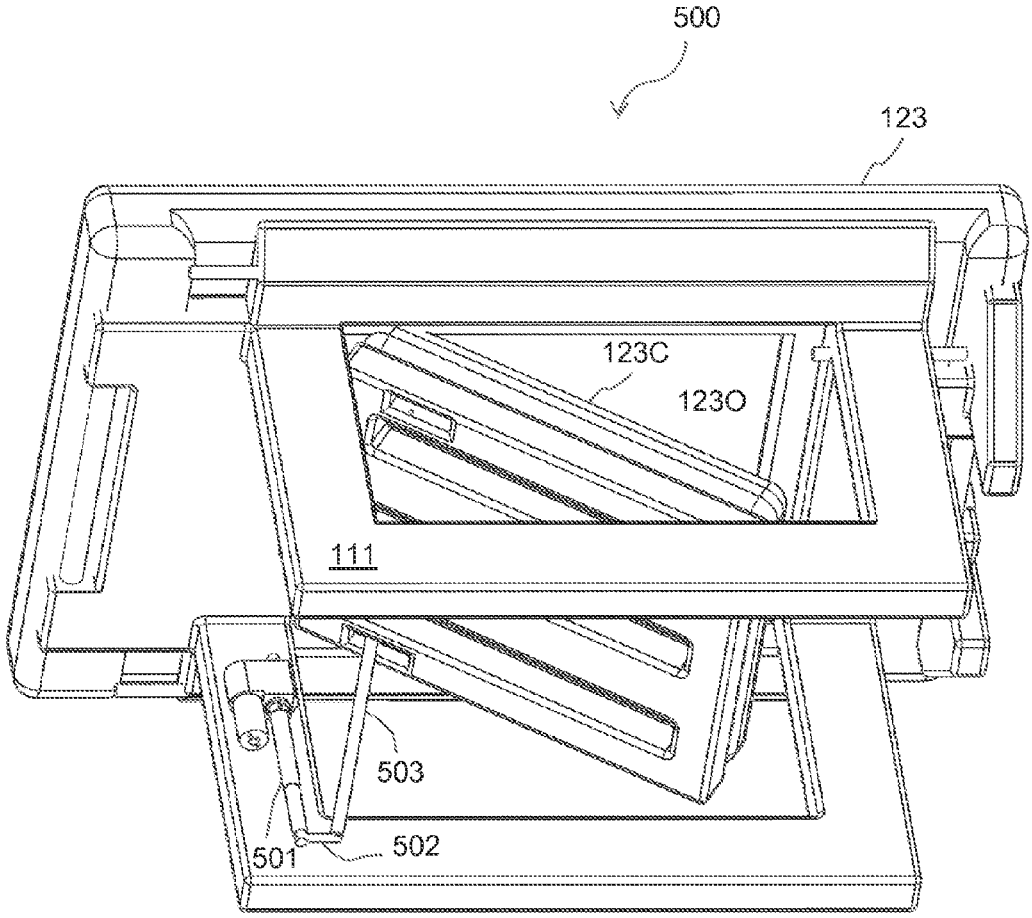
FIG. 5. is a diagram illustrating one embodiment of a pushing motor that enable the middle opening to open or close as shown in FIG. 3 in accordance with an embodiment of the present application.

Next, referring to FIG. 5, a pushing motor assembly 500 responsible for covering and revealing opening 123O is illustrated. Pushing motor assembly 500 includes a motor 501 coupled to a connecting bar 502 and a pushing bar 503. In one embodiment, there are two pushing motor assemblies 500 installed on each side of cover 123C.

In operation, when pushing motor 500 is activated, it lowers or extends pushing bar 503. When pushing motor 500 lowers pushing bar 503, cover 123C is pulled down, thus presenting opening 123O to a patient. On the other hand, when pushing motor 500 pushes up pushing bar 503, cover 123C is pushed up until cover 123C become co-planar with rectangular middle section 123.

Figure 6:
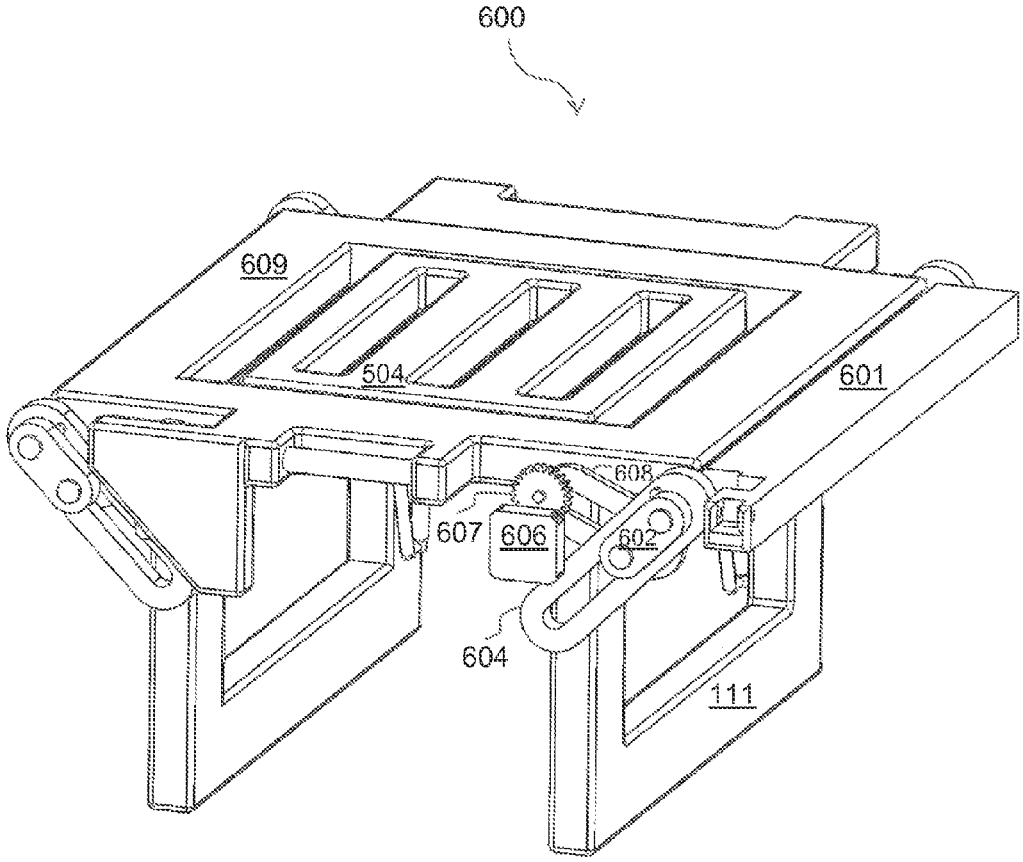
FIG. 6 is diagram illustrating a sliding assembly that enable the patient chair to change its width in accordance with an embodiment of the present invention.

Now referring to FIG. 6, a sliding assembly 600 used to change the width of rectangular middle section 123, top section 124, and bottom section 125 is illustrated. In one embodiment, first lateral subsection 123R, second lateral subsection 123L, third lateral subsection 124R, fourth lateral subsection 124L, fifth lateral subsection 125R and sixth lateral subsection 125L each is equipped with two sliding assembly 600 as discussed below.

Continuing with FIG. 6, sliding assembly 600 includes a rotating motor 606 coupled to a cogwheel 607 which, in turn, coupled to a first slider 608. A second slider 604 is coupled to first slider 608 at an opposite direction via a screw 602. Screw 602 is in turn coupled to a lateral subsection listed above.

In operation, when rotating motor 606 is activated, it cause cogwheel 607 to rotate, which causes connecting screw 602 to slide along second slider 604. As connecting screw 602 slides along second slider 604, it pulls lateral subsection connected thereto to slide down. Because second slider is connected at a predetermined angle with the surface of rectangular middle section 123, lateral subsections slide down at that predetermined angle underneath each section 123, 134, and 125. In one embodiment, the predetermined angle is set to be 45 degrees and the rotating motor has a power of 45 watts and a speed of 1,500 rounds per minute. One of skill in the art will recognize that many variations to rotating motor 606 are available and within the scope and coverage of the invention.

Figure 7:
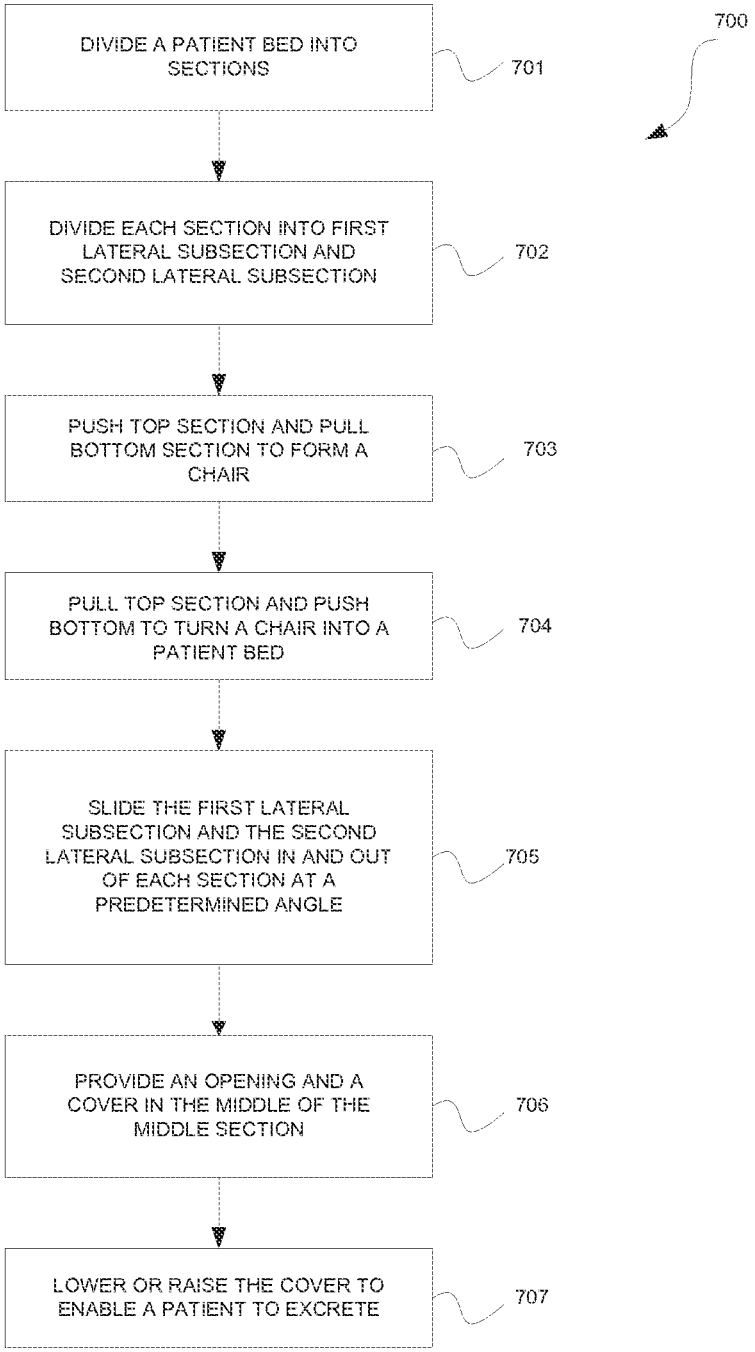
FIG. 7 is a block diagram illustrating a method of transforming a patient bed in accordance with an embodiment of the present invention.

Finally, referring to FIG. 7, FIG. 7 illustrates a method of making a convertible patient bed in accordance with an embodiment of the present invention.

At step 701, a patient bed is divided into sections. More particularly, patient bed 100 is divided into rectangular main section 123, top section 124, and bottom section 125. These sections are connected by mechanical screws well known in the art.

At step 702, divide each section into first lateral subsection and second lateral subsection. That is, top section 124 is segmented along the left side into third lateral subsection 124R and fourth lateral subsection 123L along the left hand side. Rectangular middle section 123 is segmented into first lateral subsection 123R and second lateral subsection 123L. Finally, bottom section 125 is segmented into fifth lateral subsection 125R and sixth lateral subsection 125L.

At step 703, push top section and pull bottom section to form a patient chair. Step 703 can be realized by push-pull motor assembly 400 as shown and discussed above in FIG. 4.

On the other hand, at step 704, pull top section and pull bottom section to return to patient bed from a patient chair. Step 704 is also realized by push-pull motor assembly 400.

Next, at step 705, slide the first lateral subsection and the second lateral subsection in and out of each section at a predetermined angle to change the width of each section. Step 705 is realized by rotating motor assembly 600 as shown and discussed above in FIG. 6

At step 706, an opening is provided in the middle of rectangular middle section in order to facilitate a patient's needs. Step 706 is realized by opening 123O as shown and discussed in FIG. 5 above.

Finally at step 707, lower or raise a cover. Step 707 is realized by pushing motor assembly 500 as shown and discussed in FIG. 5. In one embodiment, pushing motor 501 has a power of 40 watts and a speed of 40 rounds per minute.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A patient bed, comprising:

a supporting frame having a first caster wheel, a second caster wheel, a third caster wheel, and a fourth caster wheel;

a rectangular middle section, mechanically connected to said supporting frame, having a top side, a bottom side, a left side, and a right side, wherein said middle section further includes a first lateral subsection and said second lateral subsection, wherein said first lateral subsection slidably connected to said right side of said rectangular middle section, said second subsection slidably connected to said left side of said rectangular middle section, and wherein said rectangular middle section further comprises an opening and a removable cover, said opening configured to allow a patient to excrete when said removable cover is opened;

a top section, mechanically connected to said supporting frame and to said top side of said rectangular middle section, said top section further comprises a third lateral side and a fourth lateral side;

a bottom section, mechanically connected to said supporting frame and to said bottom side of said rectangular middle section, said bottom section further comprises a fifth lateral section and a sixth lateral section;

a first sliding assembly, mechanically connected to said rectangular middle section, said top section, and said bottom section on said right side of said rectangular middle section;

a second sliding assembly, mechanically connected to said rectangular middle section, said top section, and said bottom section on said left side of said rectangular middle section, wherein said first sliding assembly and said second sliding assembly are operable to simultaneously push and lower said top section and said bottom section so that said patient bed transforms into a sitting chair;

a first lateral top sliding assembly mechanically connected to a top side of said first lateral subsection;

a first lateral bottom sliding assembly mechanically connected to a bottom side of said first lateral subsection, wherein said first lateral top sliding assembly and said first lateral bottom assembly are operable to simultaneously slide said first lateral subsection in and out underneath said rectangular middle section at a predetermined angle so as to change the width of said rectangular middle section;

a second lateral top sliding assembly mechanically connected to a top side of said second lateral subsection;

a second lateral bottom sliding assembly mechanically connected to a bottom side of said second lateral subsection, wherein said second lateral top sliding assembly and said second lateral bottom assembly are operable to simultaneously slide said second lateral subsection in and out underneath said rectangular middle section at said predetermined angle so as to change the width of said rectangular middle section;

a third lateral top sliding assembly mechanically connected to a top side of said third lateral subsection;

a third lateral bottom sliding assembly mechanically connected to a bottom side of said third lateral subsection, wherein said third lateral top sliding assembly and said third lateral bottom assembly are operable to simultaneously slide said third lateral subsection in and out underneath said top section at a predetermined angle so as to change the width of said top section;

a fourth lateral top sliding assembly mechanically connected to a top side of said fourth lateral subsection;

a fourth lateral bottom sliding assembly mechanically connected to a bottom side of said fourth lateral subsection, wherein said fourth lateral top sliding assembly and said fourth lateral bottom assembly are operable to simultaneously slide said fourth lateral subsection in and out underneath said top section at said predetermined angle so as to change the width of said top section;

a fifth lateral top sliding assembly mechanically connected to a top side of said fifth lateral subsection;

a fifth lateral bottom sliding assembly mechanically connected to a bottom side of said fifth lateral subsection, wherein said fifth lateral top sliding assembly and said fifth lateral bottom assembly are operable to simultaneously slide said fifth lateral subsection in and out underneath said top section at a predetermined angle so as to change the width of said bottom section;

a sixth lateral top sliding assembly mechanically connected to a top side of said sixth lateral subsection; and a sixth lateral bottom sliding assembly mechanically connected to a bottom side of said sixth lateral subsection, wherein said sixth lateral top sliding assembly and said sixth lateral bottom assembly are operable to simultaneously slide said fourth lateral subsection in and out underneath said bottom section at said predetermined angle so as to change the width of said bottom section; wherein said first sliding assembly comprises a main bar, a first moving block, a second moving block, a top arm mechanically connected to said top section, a bottom arm mechanically connected to said bottom section, and a moving motor, wherein upon activation of said moving motor, said moving motor causes said first moving block and said second moving block are configured to move back and forth freely in a linearly manner along said main bar, when said first moving block and said second moving block move along said main bar from left to right, said top arm pushes said top section and at the same time said bottom arm pulls said bottom section downward, turning said patient bed into said sitting chair, wherein when said first moving block and said second moving block glides along said main bar from right to left, said top arm pulls section top section and at the same time said bottom arm pushes said bottom section, turning said sitting chair back to said patient bed, wherein said moving motor has a power of 28 watts and a speed of 40 rounds per minutes.

2. The patient bed of claim 1 further comprising a right-hand wing hingedly connected to said first lateral sub-section and said left-hand wing hingedly connected to said second lateral sub-section.

3. The patient bed of claim 2 wherein said right-hand wing and said left-hand wing comprise a large surface area configured to support and protect a patient.

4. The patient bed of claim 2 wherein when said first lateral subsection and said second lateral subsection glide underneath said rectangular middle section, said right-hand wing and said left-hand wing also slide in to fit nuggedly to said right side and left side of said rectangular middle section respectively.

5. The patient bed of claim 1 wherein said first lateral top sliding assembly and said first lateral bottom sliding assembly further comprises a cogwheel, a first slider coupled to said cogwheel, a rotating motor coupled to said cogwheel, and a second slider coupled to said first slider at an angle opposite to said first slider and forming said predetermined angle with said rectangular middle section, wherein when said rotating rotor rotates said cogwheel also rotates causing said second slider to slide up or down underneath said rectangular middle section thus changing the width of said rectangular middle section.

6. The patient bed of claim 1 wherein said second lateral top sliding assembly and said second lateral bottom sliding assembly further comprises a cogwheel, a first slider coupled to said cogwheel, a rotating motor coupled to said cogwheel, and a second slider coupled to said first slider at an angle opposite to said first slider and forming said predetermined angle with said rectangular middle section, wherein when said rotating rotor rotates said cogwheel also rotates causing said second slider to slide up or down underneath said rectangular middle section thus changing the width of said rectangular middle section.

7. The patient bed of claim 1 wherein said third lateral top sliding assembly and said third lateral bottom sliding assembly further comprises a cogwheel, a first slider coupled to said cogwheel, a rotating motor coupled to said cogwheel, and a second slider coupled to said first slider at an angle opposite to said first slider and forming said predetermined angle with said top section, wherein when said rotating rotor rotates said cogwheel also rotates causing said second slider to slide up or down underneath said top section thus changing the width of said top section.

8. The patient bed of claim 1 wherein said fourth lateral top sliding assembly and said fourth lateral bottom sliding assembly further comprises a cogwheel, a first slider coupled to said cogwheel, a rotating motor coupled to said cogwheel, and a second slider coupled to said first slider at an angle opposite to said first slider and forming said predetermined angle with said top section, wherein when said rotating rotor rotates said cogwheel also rotates causing said second slider to slide up or down underneath said top section thus changing the width of said top section.

9. The patient bed of claim 1 wherein said fifth lateral top sliding assembly and said fifth lateral bottom sliding assembly further comprises a cogwheel, a first slider coupled to said cogwheel, a rotating motor coupled to said cogwheel, and a second slider coupled to said first slider at an angle opposite to said first slider and forming said predetermined angle with said bottom section, wherein when said rotating rotor rotates said cogwheel also rotates causing said second slider to slide up or down underneath said bottom section thus changing the width of said bottom section.

10. The patient bed of claim 1 wherein said sixth lateral top sliding assembly and said sixth lateral bottom sliding assembly further comprises a cogwheel, a first slider coupled to said cogwheel, a rotating motor coupled to said cogwheel, and a second slider coupled to said first slider at an angle opposite to said first slider and forming said predetermined angle with said bottom section, wherein when said rotating rotor rotates said cogwheel also rotates causing said second slider to slide up or down underneath said bottom section thus changing the width of said bottom section.

11. The patient bed of claim 10 wherein said rotating motor has a power of 45 watts and a speed of 1500 round per minute.

12. The patient bed of claim 1 wherein said cover mechanically connected to a pushing motor, wherein upon activation of said pushing motor, said cover lowers said opening allowing said patient to excrete.

13. The patient bed of claim 11 wherein said pushing motor has a power of 40 watts and a speed of 40 rounds per minute.

14. The patient bed of claim 1 wherein said predetermined angle is 45 degrees.

15. The patient bed of claim 1, wherein said second sliding assembly comprises a second main bar, a third moving block, a fourth moving block, a second top arm mechanically connected to said top section, a second bottom arm mechanically connected to said bottom section, and said moving motor.

16. The patient bed of claim 15, wherein upon activation of said moving motor, said moving motor causes said third moving block and said fourth moving block are configured to move back and forth freely in a linearly manner along said second main bar, when said third moving block and said fourth moving block move along said second main bar from left to right, said second top arm pushes said top section and at the same time said second bottom arm pulls said bottom section downward, turning said patient bed into said sitting chair.

17. The patient bed of claim 16, wherein when said first moving block and said second moving block glides along said second main bar from right to left, said top arm pulls section top section and at the same time said bottom arm pushes said bottom section, turning said sitting chair back to said patient bed.

18. The patient bed of claim 17, wherein said moving motor has a power of 28 watts and a speed of 40 rounds per minutes.

19. The patient bed of claim 1, wherein said removable cover is mechanically connected to a first pushing bar, a first connecting bar, and a first cover motor on one side of said removable cover, wherein said removable cover is also mechanically connected to a second pushing bar, a second connecting bar, and a second cover motor on the other side of said removable cover.

20. The patient bed of claim 19, wherein said removable cover is opened by rotating said first cover motor and said second cover motor in a first direction, causing said first connecting bar and said connecting bar to rotate away from said opening and pull said first pushing bar and said second pushing bar simultaneously to open said removable cover, wherein said removable cover is closed by rotating said first cover motor and said second cover motor in the opposite direction with said first direction, causing said first connecting bar and said second connecting bar to rotate toward said opening and push said first pushing bar and said second pushing bar simultaneously to close said removable cover.

* * * * *